US007493780B2

(12) United States Patent
Stingel et al.

(10) Patent No.: US 7,493,780 B2
(45) Date of Patent: Feb. 24, 2009

(54) KNITTING METHOD AND KNITTING TOOL

(75) Inventors: Uwe Stingel, Messstetten (DE); Manfred Sauter, Storzingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/889,399

(22) Filed: Aug. 13, 2007

(65) Prior Publication Data

US 2008/0034804 A1 Feb. 14, 2008

(30) Foreign Application Priority Data

Aug. 11, 2006 (EP) ..... 06016764

(51) Int. Cl.
*D04B 7/04* (2006.01)

(52) U.S. Cl. ..... 66/64

(58) Field of Classification Search ..... 66/64, 66/66, 75.1, 116

See application file for complete search history.

(56) References Cited

U.S. PATENT DOCUMENTS

| | | | | |
|---|---|---|---|---|
| 1,286,349 A | | 8/1918 | Kopp | |
| 2,030,261 A | * | 2/1936 | Lombardi | 66/121 |
| 2,111,450 A | | 3/1938 | Jones | |
| 2,696,721 A | | 12/1954 | Shortland | |
| 2,970,460 A | * | 2/1961 | Boyer et al. | 66/140 R |
| 3,143,868 A | | 8/1964 | Palange | |
| 3,194,029 A | | 7/1965 | Tenconi | |
| 3,979,927 A | | 9/1976 | Bessi | |
| 4,314,461 A | | 2/1982 | Conti | |

FOREIGN PATENT DOCUMENTS

| | | |
|---|---|---|
| DE | 1241030 | 8/1964 |
| DE | 2524827 | 2/1976 |
| DE | 2950147 | 7/1980 |
| DE | 3100726 | 8/1982 |
| DE | 3102451 | 8/1982 |

OTHER PUBLICATIONS

Purl Warp Knitting Machine—A Knitting Machine with Needles, Melliand Textil Berichte, vol. 10, 1985 p. 727.

* cited by examiner

*Primary Examiner*—Danny Worrell
(74) *Attorney, Agent, or Firm*—Fitch, Even, Tabin & Flannery; Norman N. Kunitz

(57) ABSTRACT

The knitting method in accordance with the invention is based on simple knitting tools without means for closing a thread-receiving space that is created by a simple cutout configured as a stitch support shoulder. In the simplest case, the stitch is formed by a simple back-and-forth movement of two knitting tools relative to each other, whereby said knitting tools can be arranged approximately at a right angle with respect to each and can be alternately pierced through each other. In so doing, the taken up thread is pushed through the half stitch respectively carried by the other knitting tool.

The knitting method is based on simple and sturdy tools that are minimally susceptible to wear. Considering the manufacture of left-left knitted goods, this method permits, in addition, a significant increase in productivity compared with conventional machines while, at the same time, featuring greater simplicity of the knitting process and of the knitting tools.

14 Claims, 9 Drawing Sheets

KNITTING METHOD AND KNITTING TOOL

CROSS REFERENCE TO RELATED APPLICATION

This application claims the priority of European Patent Application No 06 016 764.0, filed on Aug. 11, 2006, the subject matter of which, in its entirety, is incorporated herein by reference.

BACKGROUND OF THE INVENTION

The invention relates to a tool for the formation of loops in a knitting machine or loop-forming machine.

In order to produce knitted goods, e.g., on circular knitting machines, flat-bed knitting machines or loop-forming machines, needles are used that have a hook associated with a closing element, for example, configured as a pivotally supported latch, or even configured as a slider. Such knitting tools represent technically sophisticated parts that necessitate considerably complex manufacturing processes due to precision requirements. Furthermore, dirt and wear can impair in particular the function of movable parts.

In addition to these, there are loop-forming processes for knitting tools which do not use movable parts. For example, document DE 12 41 030 discloses a loop-forming process using two bars which can be moved relative to each other and which support apertured needles. The apertured needles have thread openings, respectively configured as an eye with a closed rim. In so doing, the thread is continuously caught in the apertured needle, thus requiring a special loop-forming technique.

A further problem is presented by the manufacture of left-left knitted goods with the use of knitting or loop-forming machines. Left-left knitted goods are knitted goods with visually dominant rows of left stitches on both knitted sides. Left-knitted rows of stitches are rows of stitches where the stitch feet are located in front of the stitch heads of the row of stitches below. In contrast, right-knitted rows of stitches are rows of stitches where the stitch heads of the affected row of stitches are located in front of the feet of the subsequent row of stitches.

Considering this, it is the object of the present invention to suggest a loop-forming method which only requires the use of simple sturdy knitting tools. Furthermore, it is the object of the invention to suggest a method with which left-left knitted goods can be produced in a simple and highly productive manner. Furthermore, it is the object of the invention to disclose a knitting tool appropriate therefor.

SUMMARY OF THE INVENTION

These objects are achieved with the methods in accordance with claim 1, as well as with the knitting tool in accordance with claim 10:

The inventive method is based on knitting tools which have an open, preferably non-closable cutout, e.g., in the form of a loop support shoulder in order to receive a thread of one stitch or of a half-stitch and which are disposed to slide or push the thread or the half-stitch through an already existing stitch that has been taken up by another corresponding knitting tool.

The inventive knitting method requires only knitting tools which comprise elastic parts or sections, however, do not otherwise require any movable parts whatsoever. The susceptibility to wear and dirt is reduced and the manufacturing expenses are lowered. In addition, the thread can be placed in a simple manner in the non-closable cutout of the knitting tools.

Referring to the inventive method, the thread placed in a knitting tool is pushed through the stitch loop that is held by an oppositely arranged tool. This tool can be configured exactly like the viewed knitting tool and is preferably aligned transversely with respect thereto.

Preferably, the inventive method is used for the production of left-left knitted goods which is characterized in that the left and the right rows of stitches alternate. The inventive method can be used in knitting technology or in loop-forming technology. Referring to loop-forming technology, the loop-forming tools are divided into two groups and are synchronously moved in groups. The loop-forming tools of one group are preferably positioned next to each other at equal distances. The loop-forming tools of the one group are at an angle relative to the loop-forming tools of the other group. In one stroke, for example starting at a loop-forming tool held on a bar, a complete row of stitches is produced.

Referring to the knitting technique, the knitting tools of at least one group are asynchronously moved, e.g., in the way of a shaft moving longitudinally through the group. The inventive knitting tool is suitable for both processes. As in the case of the loop-forming technique, the knitting tools of the one group area positioned at an angle relative to the knitting tools of the other group.

The aforementioned method features a higher productivity in the production of left-left knitted goods than can be found in prior art. For example, left-left knit goods are otherwise produced on flat-bed knitting machines with latch-type needles or compound needles. After each row of stitches, the knitted product is transferred by a re-hanging operation to the needle of the oppositely arranged needle bed. During this re-hanging operation, it is not possible to form a stitch with the knitting tools involved in the re-hanging operation, thus limiting productivity. In contrast, referring to the inventive method, two rows of stitches are formed during each cycle. This results in a significant increase of productivity in the manufacture of left-left knitted goods.

Additional details of embodiments of the invention are the subject matter of the drawings, the description or the claims.

BRIEF DESCRIPTION OF THE DRAWINGS

The drawings show exemplary embodiments in accordance with the invention. They show in FIG. 1 a perspective enlarged illustration of the working part of the knitting tool.

DETAILED DESCRIPTION OF THE INVENTION

Figure 1:
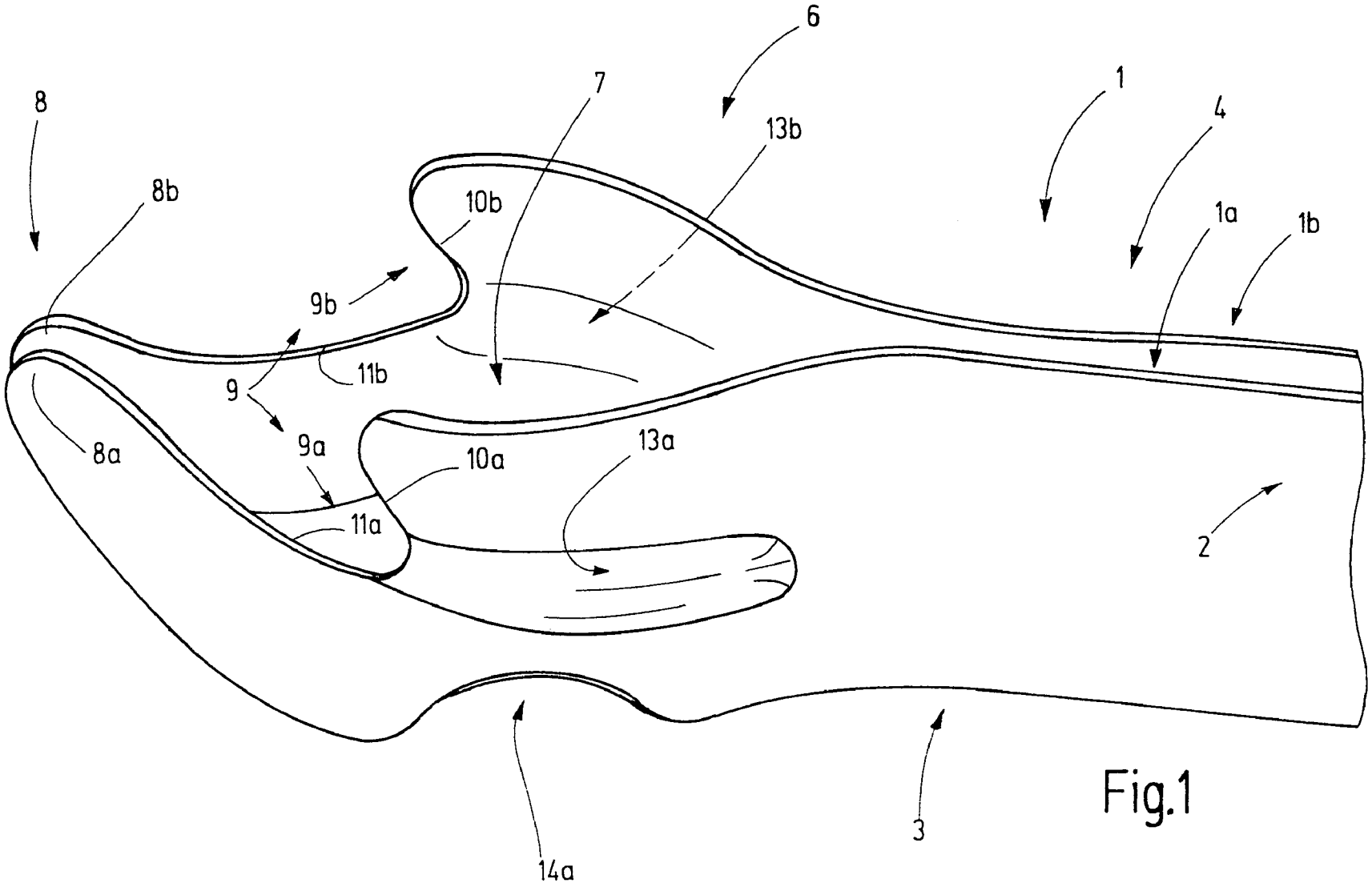
Figure 2:
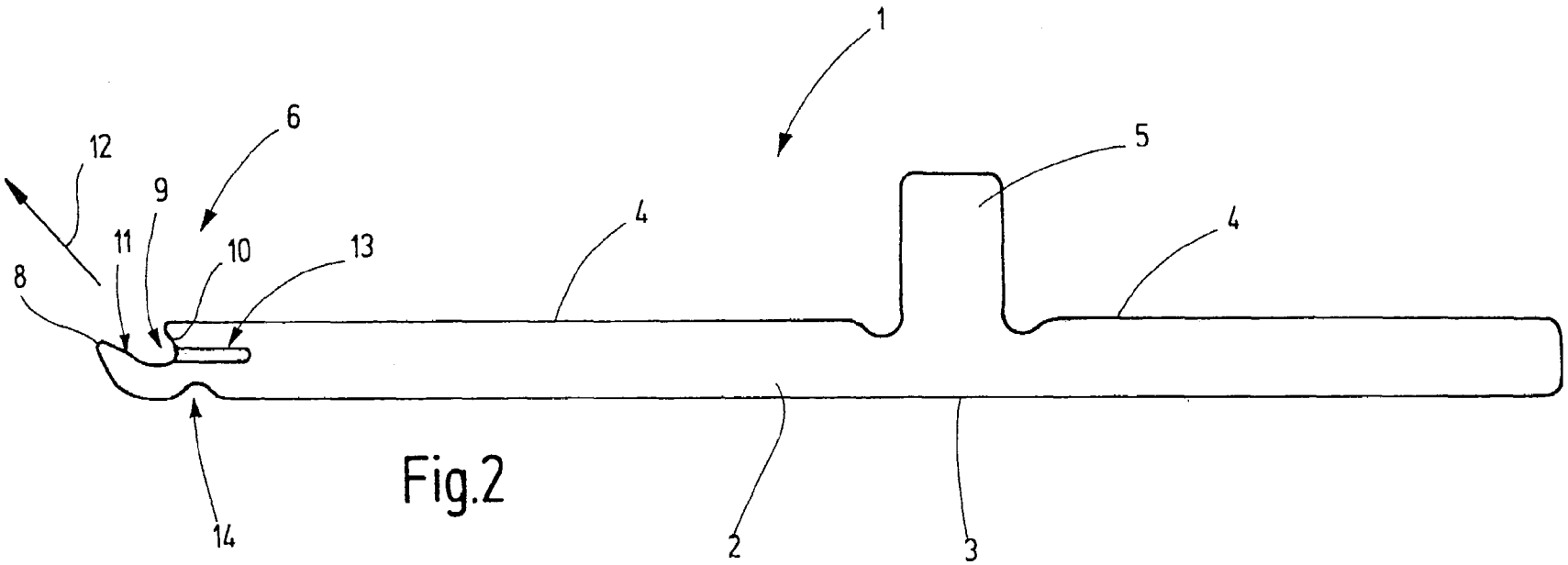
FIG. 2 a side view of the knitting tool in accordance with FIG. 1.
Figure 3:
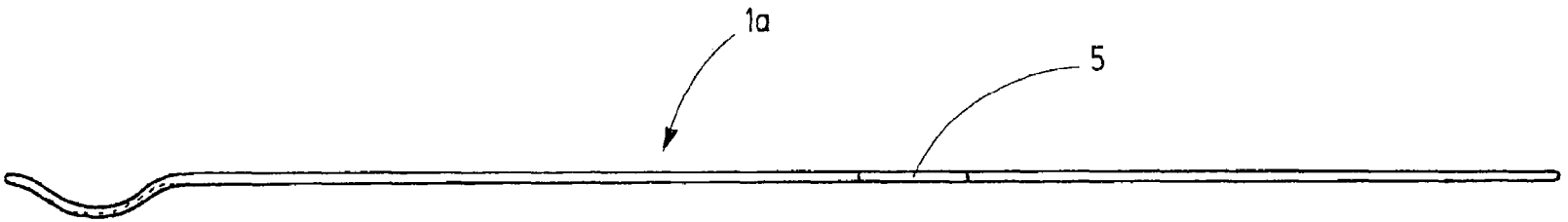
FIG. 3 a plan view of (a part of) the knitting tool in accordance with FIG. 2.
Figure 4:
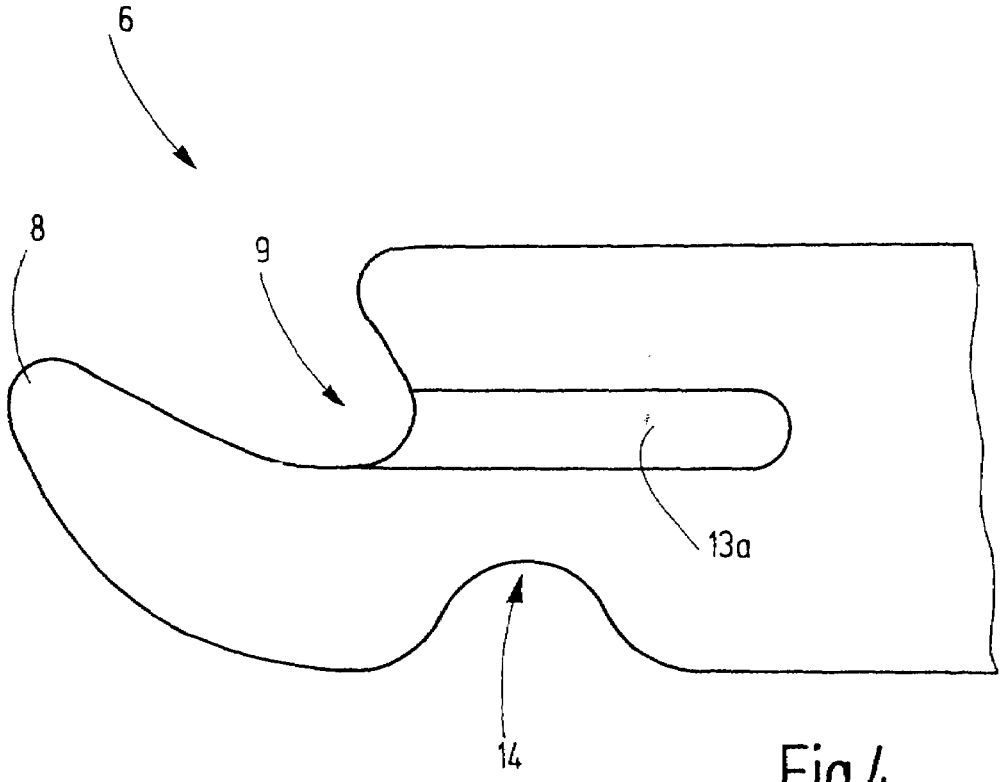
FIG. 4 an enlarged view of a detail of the knitting tool in accordance with FIG. 2.
Figure 5:
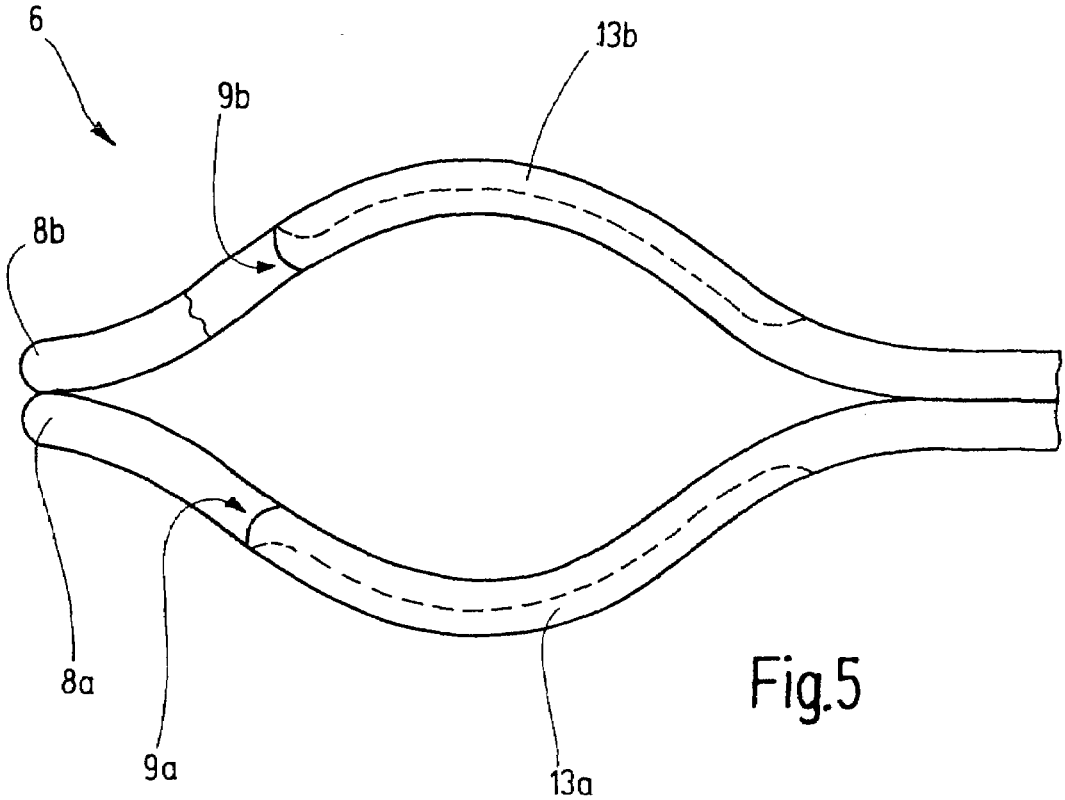
FIG. 5 a plan view of a detail of the knitting tool in accordance with FIGS. 1 and 2.

FIG. 1 shows a knitting tool 1 which, as is shown by FIG. 2, has a longitudinal body 2 made of flat material, for example, said body preferably terminating downward in a straight narrow edge 3. On its opposite side (upper side), the body 2 also has an edge 4, from which projects a foot 5. The foot 5 is used to drive the knitting tool 1, for example, by means of a cam of a knitting machine. However, referring to the present embodiment or to a modified form, said foot may also be used only in order to hold the knitting tool 1 in place on the bar of a loop-forming machine. The foot may be replaced by any other coupling or attachment means.

On one end 6, the knitting tool 1 has the loop-forming part illustrated separately in FIG. 1, in which case it has also been made clear by FIG. 1 that the knitting tool 1 consists of preferably mirror-symmetrically configured and arranged parts 1*a*, 1*b*. These are respectively configured as flat plane parts that are first bent away from each other on their ends and then again bent onto each other in order to limit a piercing opening 7. At their tips 8*a*, 8*b*, the parts 1*a*, 1*b*, together, form one tip 8. The tips 8*a* may be in resilient abutment with each other or also define a minimal gap between each other. The parts 1*a*, 1*b* may be separately manufactured parts that are positioned loosely next to each other. These parts may also be joined to each other or may represent sections of one and the same part.

The knitting tool 1 has a cutout 9 for receiving stitches. This cutout 9 opens diagonally with respect to the edge 4 or to the edge 3, and is open at all times. There are no means provided for closing this cutout 9. The open cutout 9 has a mouth-like configuration and is limited in the direction of movement by a stitch support shoulder or thread support shoulder 10. The stitch support shoulder 10 extends in a somewhat diagonal direction to the edges 3 and 4. As is obvious from FIG. 1, the cutout 9 and the stitch support shoulder 10 are formed by appropriate cutouts 9*a*, 9*b* and the stitch support shoulders 10*a*, 10*b*, as well as by the edges 11*a*, 11*b* of the two parts 1*a*, 1*b*.

In so far, the required basic features of the knitting tool 1 have been described. Optionally, said tool may have additional features. These include, for example, that the edges 3, 4 may be slightly rounded. In particular, the approximately funnel-shaped cutout 9 may be designed without corners or edges. In so doing, the edge 4 turns into the cutout 9 via a rounded portion, said cutout terminating in a rounded manner at the tip 8. In addition, the edge limiting the cutout 9 may be rounded in transverse direction, so that a taken-up thread does not contact any sharp edges. The two edges limiting the cutouts 9 together—i.e., on the one hand the stitch support shoulder 10 and, on the other hand, an edge 11—subtend a preferably acute angle. Referring to FIG. 2, this angle opens diagonally inclining away from the edge 3. The opening direction is marked by an arrow 12 in FIG. 2.

Another advantageous, however optional, feature is a thread guide groove 13 which extends from the stitch support shoulder 10 over the outside of the knitting tool 1. The part 1*a* has a thread guide groove 13*a*, while the part 1*b* has a thread guide groove 13*b*. These thread guide grooves permit the reduction of the distance between adjacent knitting tools 1 and hence permit the protection of the thread. As illustrated, these grooves may be straight, strip-shaped or may even be a groove that widens in a direction away from the thread support shoulder 10. Referring to the exemplary embodiment, the groove extends parallel to the edge 3, whereby it may also extend in another direction, depending on the stitch that is later hanging on the knitting tool 1.

Furthermore, an additional cutout 14 (14*a*) may be provided which interrupts the edge 3 and may be arranged inclined under the cutout 9. This permits the formation of particularly small stitches.

Figure 6:
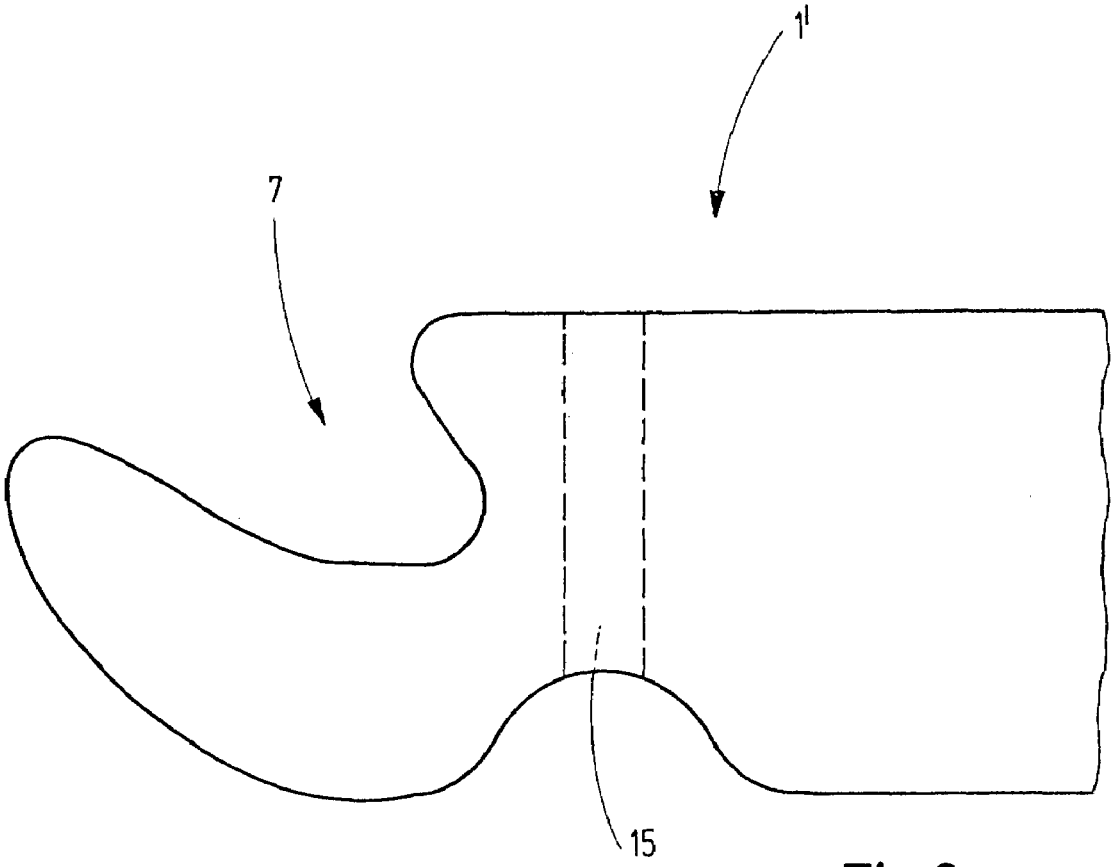
FIG. 6 a side view of a detail of the knitting tool in accordance with the invention, in a modified embodiment.
Figure 7:
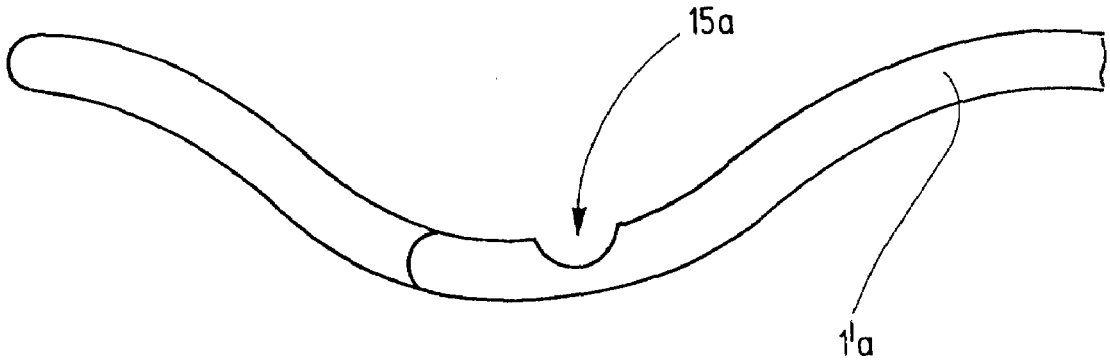
FIG. 7 a plan view of a detail of the knitting tool in accordance with FIG. 6.

During the knitting operation, the thread guide groove 13 is additionally helpful in providing extra space for a thread that is lying against the outside of the knitting tool during the stitch formation, when the knitting tool pierces through the piercing opening 7 of another knitting tool. In order to facilitate this operation, it is possible—is illustrated by FIGS. 6 and 7 referring to a knitting tool 1', 1*a*'—to provide another thread guide groove 115 (15*a*) on the inside of the piercing opening 7 of the knitting tool 1. This latter thread guide groove extends in piercing direction. If knitting tools that are associated with each other are arranged at a right angle relative to each other, the thread guide groove 15, 15*a* is preferably aligned approximately at a right angle to the edge 3. As is shown, the thread guide groove 15 can have a round, trapezoid or flat or other configuration.

The knitting tool 1 in accordance with the invention may be designed in one, two or even in multiple parts. It may be a stamped part, whereby both parts 1*a*, 1*b* are formed by means of a bending operation. If the knitting tool 1 is made of several parts, they may be joined to each other in a detachable or non-detachable manner. To achieve this, any suitable joining technology may be used, such as, for example, cementing, welding, caulking, embossing, soldering, etc. It is also possible to arranged the two parts 1*a*, 1*b* together in a channel of a tool carrier, without joining said parts. Inasmuch as the foot is provided at the same location of the parts 1*a*, 1*b*, these parts are moved back and forth together in longitudinal direction. Instead of the foot 5, any other coupling means may be used.

Figure 8A:
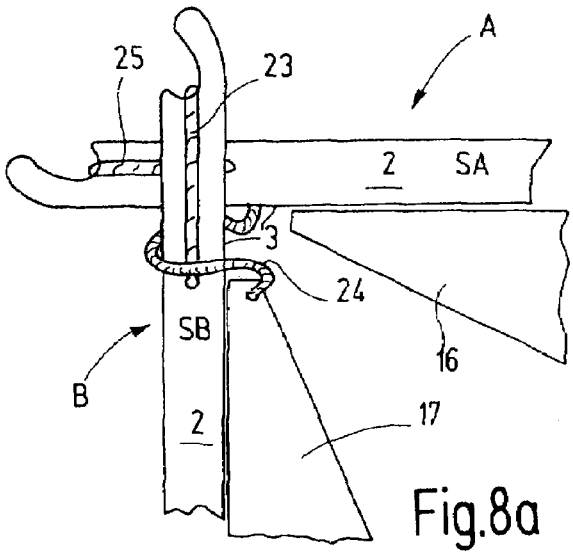
FIGS. 8*a* through 8*e* a schematic illustration of the process of stitch formation with the inventive knitting tools when carrying out the inventive method for the manufacture of left-left knitted goods.

FIGS. 8*a* through 8*e* are schematic illustrations of the process of stitch formation with the use of knitting tools that correspond to the knitting tool 1. The knitting tools are divided into two groups A, B. Each group A, B comprises respectively one defined number of knitting tools of the same type, said tools being moved synchronously or asynchronously in the manner of a continuous shaft. In order to illustrate the activity of two interacting knitting tools of the groups A and B, the knitting tools SA, SB that correspond to the knitting tool 1 are used in the subsequent Figures. Said knitting tools are arranged in beds 16, 17 and are moved forward and backward, i.e., respectively parallel to their edges 3, by suitable means. As shown by FIG. 8*a*, the directions of movement are essentially at a right angle with respect to each other, as are the orientations of the knitting tools SA, SB. The bed 16 may represent, for example, the dial of a circular knitting machine, whereas the bed 17 may represent, for example, the knitting cylinder of a circular knitting machine.

Figure 8B:
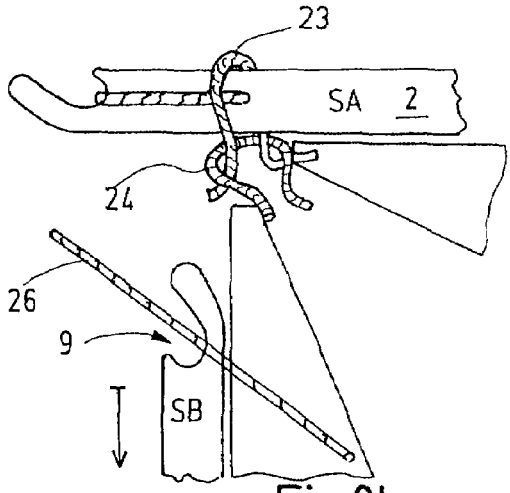
Figure 8C:
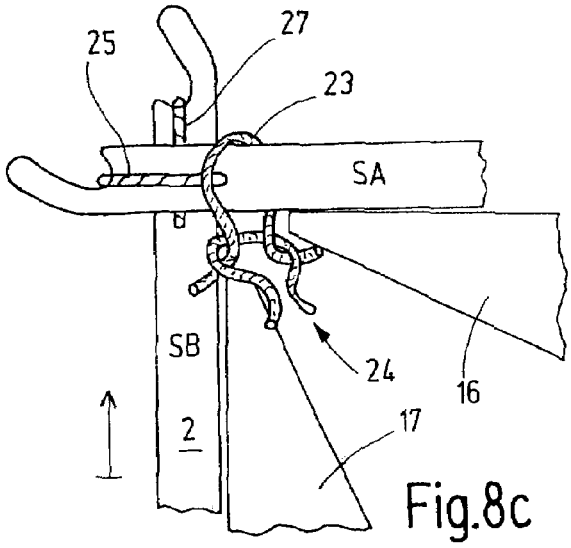
Figure 8D:
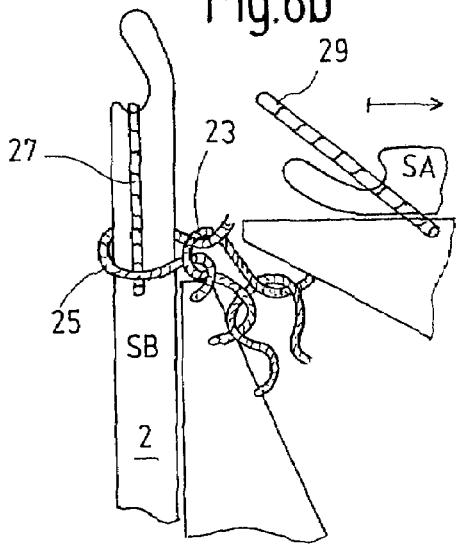
Figure 8E:
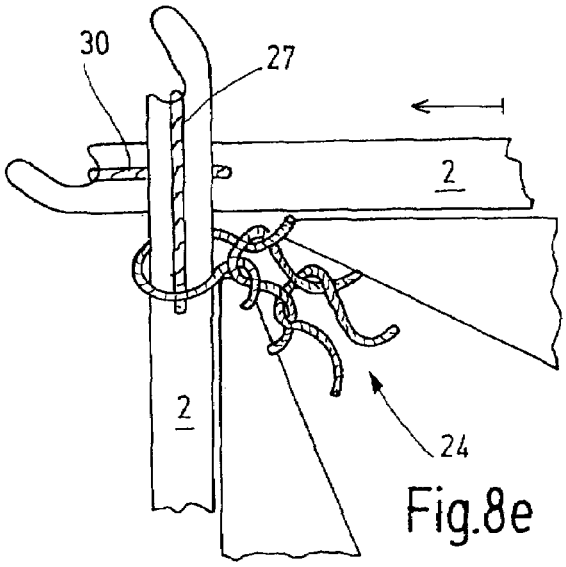
Figure 8:
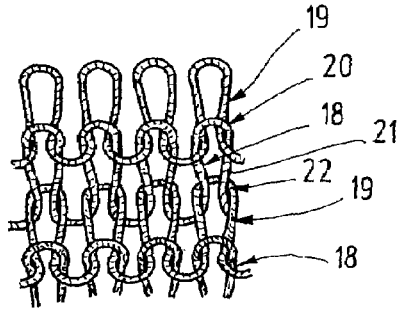
FIG. 8 left-left knitted goods.

Referring to FIG. 8, the process of producing left-left knitted goods will be illustrated hereinafter. In left-left knitted goods, respectively one row of left stitches 19 and one row of right stitches 18 follow each other. In the row of left stitches 19, the heads 22 are located behind the wales 21 of the subsequent row. In the right-stitch row of stitches 18, the heads 20 of the stitches are located in front of the wales of the subsequent row of stitches 19.

The knitting tools SA, SB are centered with respect to each other, i.e., they area located on a joint plane. The tip of each knitting tool SA, SB can therefore pierce through the piercing opening 7 of the other knitting tool. In so doing, the stitches are produced as follows:

Reference is made to FIG. 8*a*. The two limbs of the knitting tool SA are pierced into the piercing opening 7 between the two limbs of the knitting tool SB of the other group. The knitting tool SB carries a half stitch 23, by which the knitted material 24 is suspended. The knitted material is drawn off between the two beds 16, 17. The knitting tool SA pierces a half stitch 25 taken up in its take-up space through the half stitch 23.

In the next step, as shown by the transition to FIG. 8*b*, the knitting tool SB is retracted, while the knitting tool SA remains driven out. As a result of this, the half stitch 23 is transferred to the knitting tool SA. Now, the half stitch 23 rests on the shaft 2 of the knitting tool SA. When the knitting tool SB is retracted, the half stitch 24, which (in FIG. 8*a*) rested on the shaft or the body 2 of the knitting tool SB, is cast off and formed to produce stitch 24. The latter represents a new stitch of a row of stitches.

Then the thread 26 is placed in the cutout 9 of the knitting tool SB. This operation is also referred to as wrapping or throwing the thread. During the subsequent drive-out of the stitch element SB, the thread 26 is grasped and pushed as the half stitch 27 through the half stitch 25 held by the knitting tool SA. This is shown by FIG. 8*c*.

In the next step, as shown by FIG. 8*d*, the knitting tool SA is retracted into the rear reversal position. In so doing, the thread loop or half stitch 25 is placed over the thread loop or stitches 27 and the shaft 2 of the knitting tool SB. The half stitch 23 that was previously placed around the shaft 2 of the knitting tool SA is cast off and forms a new stitch 23 of a row of stitches. Referring to the described knitting cycle, this is the second row of stitches. Consequently, it is possible to produce stitches of two successive rows of stitches in one cycle of motion of the knitting tools SA, SB. In each case, one cycle of motion involves the drive-out and the retraction of both knitting tools SA, SB. In other words, two rows of stitches are produced during one cycle of motion in one knitting system. The latter rows are one left-stitch and one right-stitch row of stitches.

Subsequently, the knitting tool SA is again driven out, in which case the fed yarn 29 is grasped and, as shown by FIG. 8*e*, pierced as a half stitch 30 through the half stitch 27. Now the knitting tools SA, SB are again in their starting position in accordance with FIG. 8*a*, thus making it possible for the described working cycle to begin anew.

In summary it should be noted that, during one cycle of motion, two rows of stitches are produced: in the described case, one row of right stitches, as well as one row of left stitches. It is not necessary to provide an additional needle stroke for re-hanging the rows of stitches, as is the case in conventional flat-bed knitting machines. In addition, it is not necessary to transfer the loop-forming element (e.g., a needle with two latches, also referred to as the "left needle") from one needle bed to the opposite needle bed, as is the case in conventional dual-cylinder machines and in left-left flat-bed knitting machines.

Considering the above description, it has been assumed that respectively only the knitting tool SA or the knitting tool SB is being moved. In order to optimize the sequence of motion of the knitting tools, it is also possible for the two knitting tools SA, SB involved in the loop-forming process to move simultaneously. In so doing, it is possible, for example, for the knitting tools SA to carry out a movement in drive-out direction, while the knitting tool SB carries out a movement in draw-off direction. Then, they move in opposing directions. Inasmuch as the two knitting tools move at the same time, the duration of one sequence of motion for stitch formation can be reduced and, as a direct result thereof, the productivity can be increased.

Figure 9A:
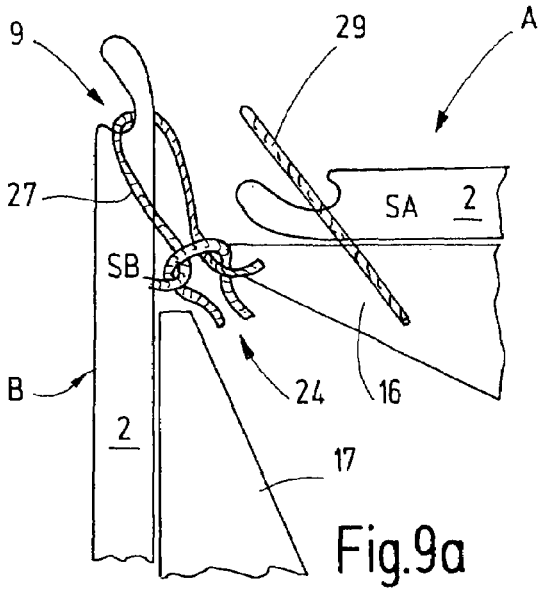
FIGS. 9*a* through 9*e* the process of stitch formation with the inventive knitting tools when carrying out the inventive knitting method for the production of right-left knitted goods.
Figure 9B:
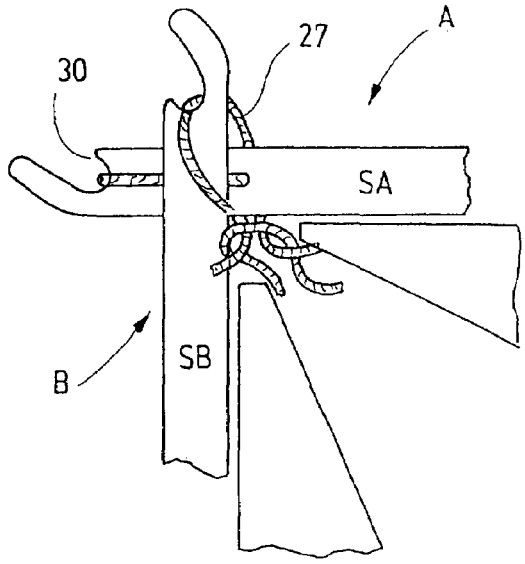
Figure 9C:
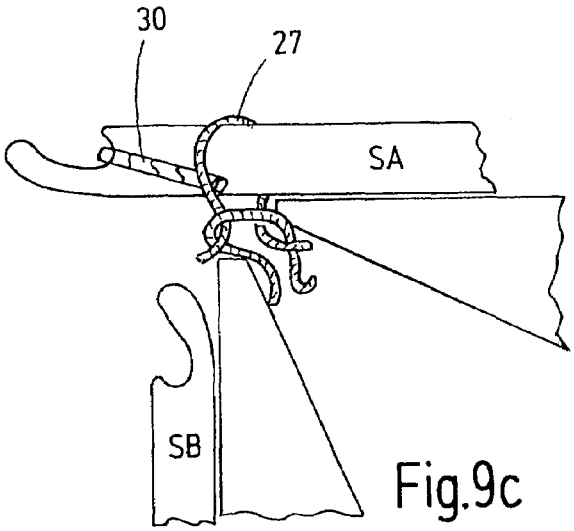
Figure 9D:
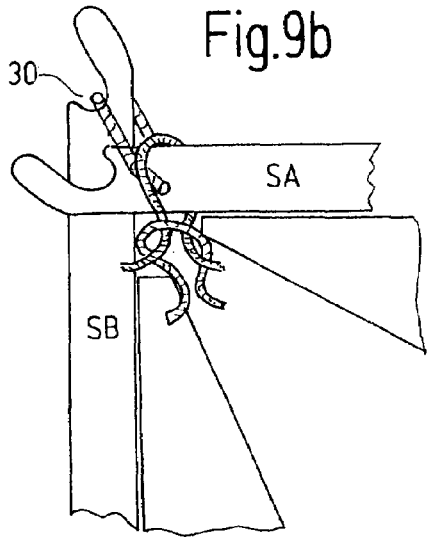
Figure 9E:
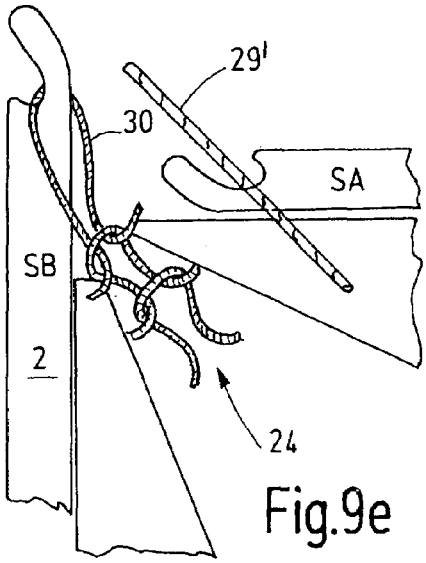
Figure 9:
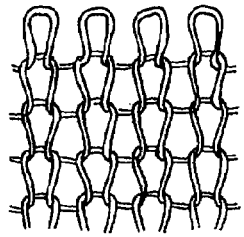
FIG. 9 right-left knitted goods.

FIG. 9 shows the so-called right-left knitted material. It consists of rows of stitches of uniform type, so that, on the one side of the knitted material, only right-stitch rows of stitches are visible and, on the other side of the knitted material, only left-stitch rows of stitches are visible. FIGS. 9*a* through 93 illustrate the knitting process for the production of such goods with the use of the knitting tools in accordance with the invention and the knitting method in accordance with the invention. Unless stated otherwise, the above explanations apply analogously.

FIG. 9*a* shows the starting position. The knitting tool SB is in the drive-out position and holds the knitted material 24. The last-formed half stitch 27 is located in the cutout 9 of the knitting tool SB. The knitting tool SA is in its rear turn-around position. The yarn 29 is being fed. In the next step, as shown by FIG. 9*b*, the knitting tool SA is driven out, so that both knitting tools SA, SB are in their drive-out position. In its drive-out position, the knitting tool SA has grasped the yarn 29 and has shaped it to produce a new thread loop 30 through the knitting tool SB, as well as through the thread loop or half stitch 27. Then, as shown by FIG. 9*c*, the knitting tool SB is retracted and the half stitch 27 is transferred to the shaft 2 of the knitting tool SA, which, in addition, holds the half stitch 30. While the knitting tool SA is retracted as shown by FIG. 9*d*, the knitting tool SB is again driven out in order to receive the half stitch 30. The knitting tool SA has then released the half stitch 30, when it has arrived in its retracting position, as shown by FIG. 93. Again, the status in accordance with FIG. 9*a* is reached so that a new thread 29' can be fed.

Figure 10A:
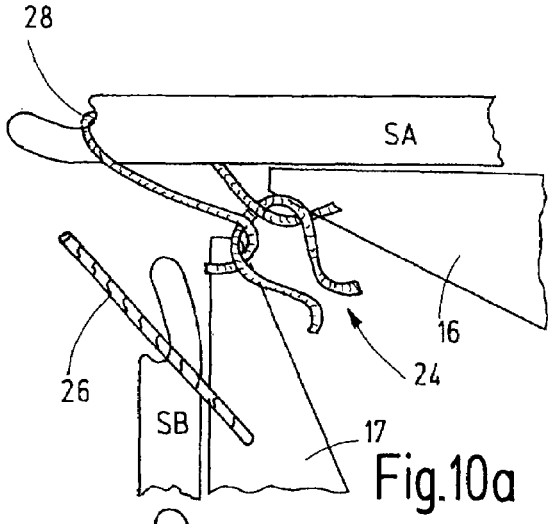
FIGS. 10*a* through 10*e* the process of stitch formation with the inventive knitting tools when carrying out the inventive knitting method for the manufacture of left-right knitted goods.
Figure 10B:
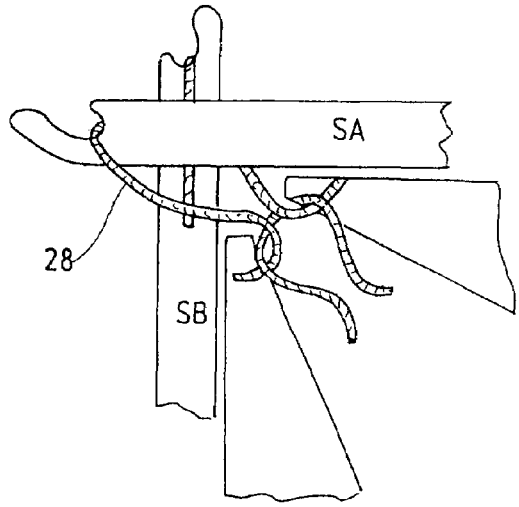
Figure 10C:
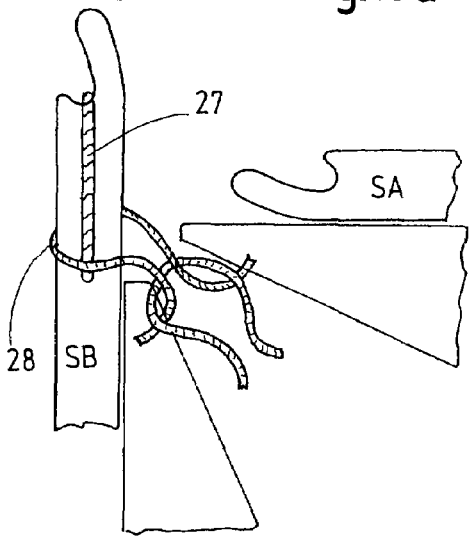
Figure 10D:
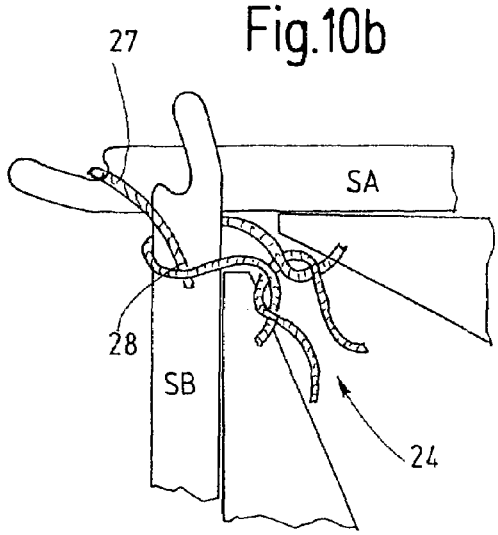
Figure 10E:
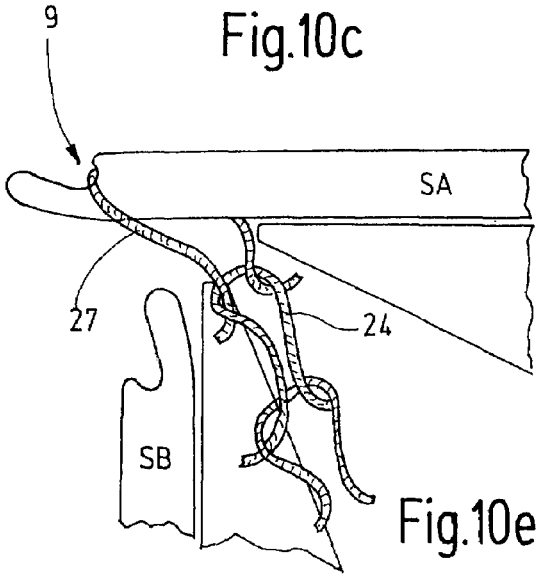
Figure 10:
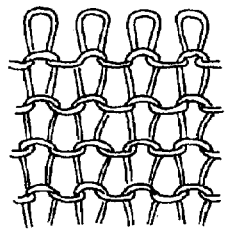
FIG. 10 left-right knitted goods.

FIG. 10 illustrates left-right knitted goods. FIGS. 10*a* through 10*e* disclose how the knitting tools in accordance with the invention are to be used to produce this knitted material. The process begins with the status in accordance with FIG. 10*a*, with the knitting tool SA driven out and the knitting tool SB retracted. The thread 26 is fed to the latter, while the knitting tool SA carries a half stitch 28. Suspended from the latter is the knitted material 24. In the next step, the knitting tool SB is driven out and thus pierced through the knitting tool SA and hence through the half stitch or the thread loop 28, as shown by FIG. 10*b*. As the knitting tool SA is retracted in accordance with FIG. 10*c*, the half stitch 28 is transferred to the shaft of the knitting tool SB and placed around the half stitch 27 formed from the thread 26. In the next step, this half stitch 27 is transferred in accordance with FIG. 10*d* to the knitting tool SA in that the latter is driven out and thus pierced through the knitting tool SB and the through the half stitch 27. The half stitch 27 is received by the cutout 9 of the knitting tool SA, while the knitting tool SB, as shown by FIG. 10*e*, is again moved back into retracting position, whereby the half stitch 28 is cast off and formed to produce stitch 24. Consequently, the stitch 27 hangs in the cutout 9 of the knitting tool SA, and the status in accordance with FIG. 10*a* has been re-established. Now, the knitting cycle can begin anew.

Referring to the knitting method in accordance with FIGS. 9 and 10, only one row of stitches is produced during each cycle. To this extent, no direct productivity advantage is attained. However, it is possible to work with particularly simple and sturdy knitting tools. There are no latches for the formation of an interior thread space having the design of a cutout 9, and there are no means for closing this thread receiving space. The knitting tools are designed to be simple and to exhibit minimal susceptibility to wear.

FIG. 11*a* through 11*h*, as well as 12*a* through 12*h*, illustrate a stitch forming process for the manufacture of right-right knitted goods with the use of the stitch-forming tools in accordance with the invention. In addition to their linear back-and-forth movement, the knitting tools carry out a tilting motion. In so doing, the yarn is taken up and knitted at a feed site, alternately by a knitting tool SA of the upper needle bed and by a knitting tool SB of the lower needle bed. Consequently, a left stitch and a right stitch are alternately knitted with the fed yarn. The processes in accordance with FIGS. 11*a* through 11*h* and 12*a* through 12*h* are alternately carried out in order to produce right-right knitted goods.

Figure 11A:
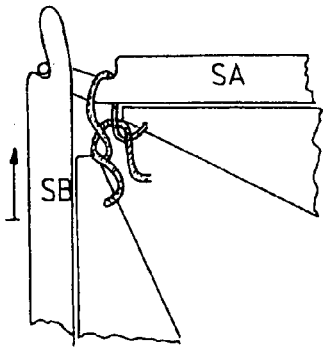
FIGS. 11*a* through 11*h* the process of stitch formation with the inventive knitting tools when carrying out the inventive knitting method for the manufacture of right-right knitted goods as the left wale is being formed; and, FIGS. 12*a* through 12*h* the process of stitch formation with the inventive knitting tools when carrying out the inventive knitting method for the manufacture of right-right knitted goods as the right wale is being formed.
Figure 11B:
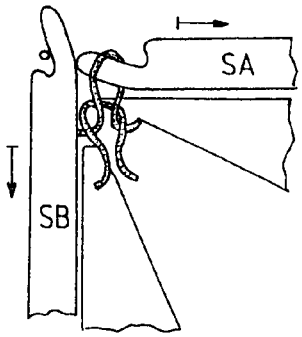
Figure 11C:
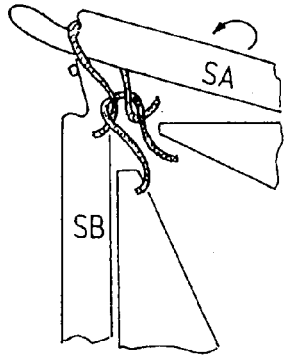
Figure 11D:
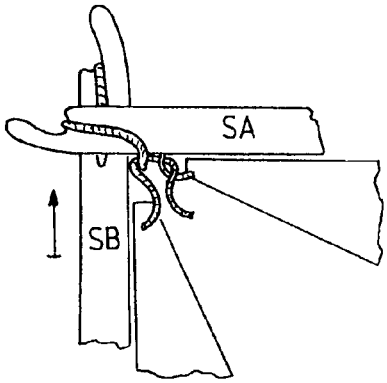
Figure 11E:
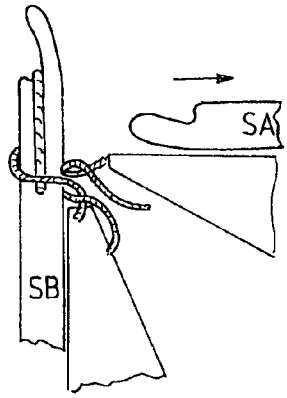
Figure 11F:
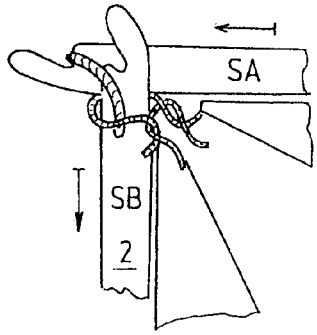
Figure 11G:
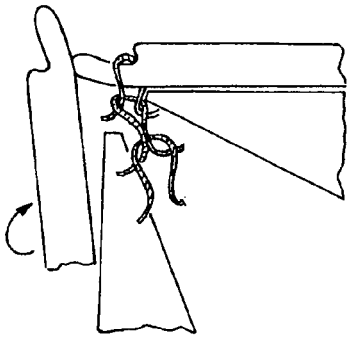
Figure 11H:
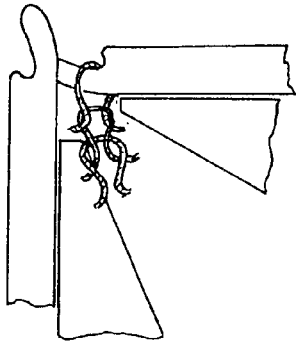
Figure 12A:
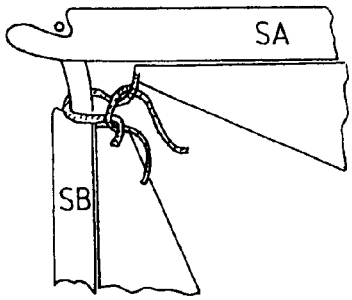
Figure 12B:
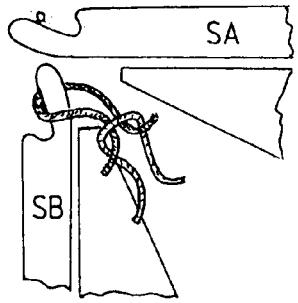
Figure 12C:
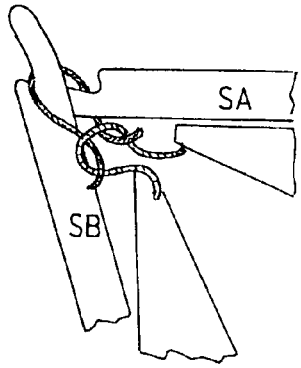
Figure 12D:
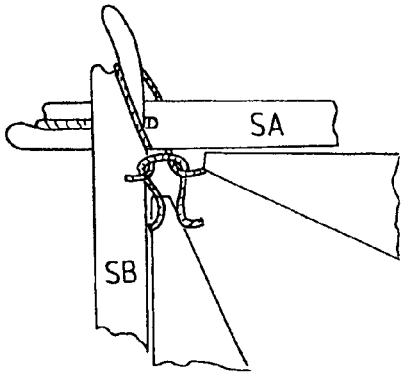
Figure 12E:
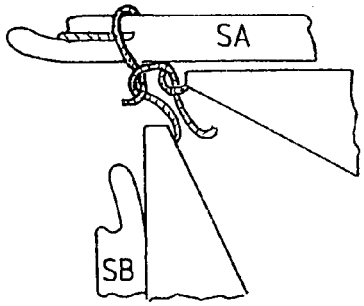
Figure 12F:
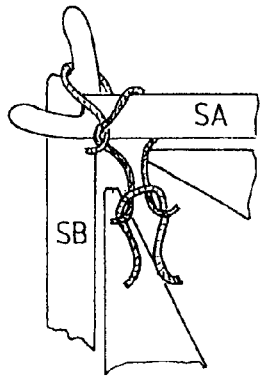
Figure 12G:
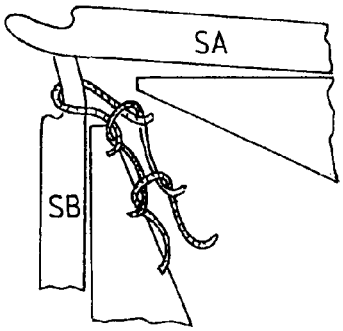
Figure 12H:
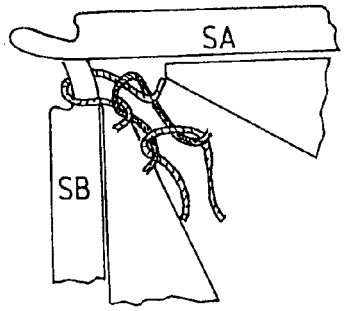

Briefly summarized, the process is as follows:

In accordance with FIG. 11*a*, the knitted material is suspended from the knitting tool SA. A thread is fed to the knitting tool SB, said thread being taken up by the initially retracting (FIG. 11*b*) and then stopping (FIG. 11*c*) knitting tool SB. Using the knitting tool SA, the last-formed half stitch, as shown by FIG. 11*c*, is lifted over the knitting tool SB and placed thereon (FIG. 11*d*). Subsequently, the knitting tool SA can be retracted (FIG. 11*e*), in which case it transfers the so-far held half stitch to the knitting tool SB. The new half stitch formed by the knitting tool SB, in drive-out mode, is taken over by the knitting tool SA, as illustrated by FIG. 11*f*, in that said tool is again driven out through the piercing space of the knitting tool SB, while the knitting tool SB is retracted, in which case the half stitch resting on the shaft 2 is cast off. In so doing, the status 11*h* is ultimately re-established via the intermediate status in accordance with FIG. 11*g*, thus allowing the knitting operation to be started anew.

The knitting operation in accordance with FIGS. 12*a* through 12*h* is analogous, whereby, in this case, the thread is not fed to the lower knitting tool SB but to the horizontal knitting tool SA. Otherwise, the above description applies, with the knitting tools SA and SB being interchanged.

The knitting method in accordance with the invention is based on simple knitting tools without closure of a thread receiving space that is represented by a simple cutout configured as a stitch support shoulder. In the simplest case, a simple back-and-forth movement of two associate knitting tools that can be arranged approximately at a right angle with respect to each other and can be alternately pierced are used for stitch formation. In so doing, the taken up thread is pushed through the half stitch respectively carried by the other knitting tool.

The knitting method is based on simple and sturdy tools that are minimally susceptible to wear. Considering the manufacture of left-left knitted goods, this method permits, in addition, a significant increase in productivity compared with conventional machines while, at the same, time featuring greater simplicity of the knitting process and of the knitting tools.

LIST OF REFERENCE NUMBERS

1 Knitting tool; 1' knitting tool; 1*a*, 1*b*, 1*a*' parts
2 Body, shaft
3 Edge
4 Edge
5 Foot
6 End
7 Piercing opening
8 Tip; 8*a*, 8*b* tips
9 Cutout; 9*a*, 9*b* cutouts
10 Stitch support shoulder; 10*a*, 10*b* stitch support shoulders
11 11*a*, 11*b* Edge
12 Arrow
13 Thread guide groove; 13*a*, 13*b* thread guide grooves
14 Cutout; 14*a* cutout
15 Thread guide groove; 15*a* thread guide groove
16 Bed
17 Bed
A, B Group
SA, SB Knitting tool
18 Row of left stitches
19 Row of right stitches
20 Head
21 Wale
22 Head
23 Half stitch/stitch
24 Knitted material/stitch/half stitch
25 Half stitch, thread loop
26 , 29 Thread/yarn
27 , 30 Half stitch, thread loop
28 Half stitch, thread loop

The invention claimed is:

1. Method for production of knitted goods with the use of two groups (A, B) of knitting tools (1, SA, SB) that are respectively arranged in a row, said tools being provided, on one end, with respectively one open cutout for receiving a thread or a stitch or half stitch, whereby:

feeding a thread to the knitting tools of one group while holding stitches by the knitting tools of the other group;

moving the tools of the other group toward the tools of the first group while tilting the tools of the other group to lift loops of the stitches over the end of the tools of the first group;

retracting the tools of the other group to transfer the stitches to the tools of the first group;

advancing the tools of the other group to engage the threads in the tools of the first group to form a new stitch; and, retracting the tools of the first group to transfer the new stitches to the tools of the other group.

2. Method in accordance with claim 1, wherein the knitting tools of at least one of the groups are moved synchronously relative to each other within the group.

3. Method in accordance with claim 1, wherein the knitting tools of both groups are moved synchronously relative to each other within each group.

4. Method in accordance with claim 1, wherein the knitting tools of both groups are moved asynchronously relative to each other within each group.

5. Method in accordance with claim 1, including alternately feeding the thread, in order to produce a left-left knitted material, in the knitting tools of the one group and in the knitting tools of the other group.

6. Method in accordance with claim 1, including feeding the thread, in order to produce a right-left knitted material or a left-left knitted material, only in the knitting tools of one of the two groups.

7. Method in accordance with claim 6, including, during the knitting process, transferring a formed row of half stitches from the knitting tools of the one group to the knitting tools of the other group.

8. Method in accordance with claim 1, including respectively moving the knitting tools in a back-and-forth manner, in which case the knitting tools of the one group are moved in a direction that is different from the direction, in which the knitting tools of the other group are moved.

9. Method in accordance with claim 8, including moving the knitting tools of the one group in a direction transverse to the knitting tools of the other group.

10. Knitting tool comprising:

at least one flat body having straight upper and lower lateral edges and provided, on one end, with a thread support shoulder that interrupts the upper lateral edge, so that the upper edge extends straight back from the shoulder so that the body is adapted to receive thread loops; and wherein the body has, at said one end, two curved, elastic limbs that limit a piercing space between them, with the limbs being configured symmetrically with respect to a center plane and each having one thread support shoulder that interrupts the respective upper lateral edge.

11. Knitting tool in accordance with claim 10, wherein the body is provided with thread guide grooves that extend from the thread support shoulder along an outer side surface of the body.

12. Knitting tool in accordance with claim 10, wherein the tips at said one end of the limbs are configured so as to abut against each other.

13. Knitting tool in accordance with claim 10, wherein each of the limbs is provided with a respective cutout on the lower edge opposite the respective thread support shoulder.

14. Knitting tool in accordance with claim 10, wherein the inside of each of the limbs is provided with a thread groove.

* * * * *